US009193028B2

(12) United States Patent
Feng et al.

(10) Patent No.: US 9,193,028 B2
(45) Date of Patent: Nov. 24, 2015

(54) SHEET FOR MOUNTING A WORKPIECE

(75) Inventors: Chung-Chih Feng, Kaohsiung (TW); I-Peng Yao, Kaohsiung (TW); Lyang-Gung Wang, Kaohsiung (TW); Wen-Chieh Wu, Kaohsiung (TW); Wei-Te Liu, Kaohsiung (TW)

(73) Assignee: SAN FANG CHEMICAL INDUSTRY CO., LTD., Kaohsiung (TW)

( * ) Notice: Subject to any disclaimer, the term of this patent is extended or adjusted under 35 U.S.C. 154(b) by 1057 days.

(21) Appl. No.: 13/287,328

(22) Filed: Nov. 2, 2011

(65) Prior Publication Data

US 2012/0126472 A1 May 24, 2012

(30) Foreign Application Priority Data

Nov. 18, 2010 (TW) ..... 99139641 A

(51) Int. Cl.
*B24B 37/30* (2012.01)
*B24B 41/06* (2012.01)

(52) U.S. Cl.
CPC ..... *B24B 37/30* (2013.01); *B24B 41/061* (2013.01)

(58) Field of Classification Search
CPC ..... B25B 11/02; A47J 47/16
See application file for complete search history.

(56) References Cited

U.S. PATENT DOCUMENTS 6,617,004 B2 * 9/2003 Lake et al. ..... 428/138
7,063,879 B2 * 6/2006 Trent et al. ..... 428/137
7,063,880 B2 * 6/2006 Karul ..... 428/143
7,078,088 B2 * 7/2006 Price et al. ..... 428/137
2008/0268223 A1 10/2008 Feng et al.
2012/0126472 A1 * 5/2012 Feng et al. ..... 269/289 R

FOREIGN PATENT DOCUMENTS

CN 101190507 A 6/2008
CN 101298129 A 11/2008
TW 200842962 11/2008

OTHER PUBLICATIONS

Office action issued on Dec. 4, 2013 by State Intellectual Property Office of China for the counterpart CN Patent Application No. 201010591675.X.
English abstract translation of the office action issued on Dec. 4, 2013 by State Intellectual Property Office of China for the counterpart CN Patent Application No. 201010591675.X.
English abstract translation of CN101298129A.
English abstract translation of CN101190507A.

* cited by examiner

*Primary Examiner* — Lee D Wilson
(74) *Attorney, Agent, or Firm* — WPAT, P.C.; Anthony King

(57) ABSTRACT

The present invention relates to a sheet for mounting a workpiece, which includes a sheet body. The sheet body includes a top surface, a plurality of foamed pores, and a plurality of surface holes or at least one surface groove. The top surface is used for mounting a workpiece. The foamed pores are disposed in the interior of the sheet body. The surface holes or the surface groove have opening on the top surface but does not communicate with the foamed pores. The surface holes or the surface groove is formed by machining, and arranged in at least one pattern. Whereby, the time for taking off the workpiece from the sheet is reduced.

12 Claims, 11 Drawing Sheets

SHEET FOR MOUNTING A WORKPIECE

BACKGROUND OF THE INVENTION

1. Field of the Invention

The present invention relates to a sheet for mounting a workpiece, and more particularly to a sheet for mounting a workpiece that has holes or grooves on a surface thereof.

2. Description of the Related Art

Polishing generally refers to control of abrasion of an originally rough surface in a chemical mechanical polishing (CMP) process, in which slurry with fine particles is evenly distributed on a top surface of a polishing pad and meanwhile a workpiece is pressed against the polishing pad to repeat abrasing regularly. The workpiece is an object such as a semiconductor, a storage medium workpiece, an integrated circuit, a liquid crystal display (LCD) flat glass, an optical glass, and a photovoltaic panel. During polishing, a sheet for mounting a workpiece is needed for carrying and retaining the workpiece, and the quality of the sheet for mounting the workpiece directly influences the polishing effect of the workpiece.

FIG. 1 is a schematic view of a polishing device using a conventional sheet for mounting a workpiece disclosed in U.S. Pat. No. 5,871,393. The polishing device 1 includes a lower base plate 11, a sheet 12, a workpiece 13, an upper base plate 14, a polishing pad 15, and slurry 16. The lower base plate 11 is relative to the upper base plate 14. A bottom surface 122 of the sheet for mounting the workpiece 12 is adhered to the lower base plate 11 by a self-adhesive layer 17, and a top surface 121 of the sheet 12 is used for carrying and retaining the workpiece 13. The polishing pad 15 is retained on the upper base plate 14 and faces the lower base plate 11, for proceeding polishing on the workpiece 13.

The operations of polishing device 1 are described as follows. Firstly, the workpiece 13 is disposed at the sheet 12, and the workpiece 13 is sucked by the sheet 12. Then, the upper base plate 14 and the lower base plate 11 rotate in opposite directions and meanwhile the upper base plate 14 moves downwards to enable the polishing pad 15 to contact a surface of the workpiece 13. The continuous refill of the slurry 16 and the function of the polishing pad 15 may realize the polishing of the workpiece 13.

Although the sheet 12 is capable of mounting the workpiece 13, after the polishing is completed, it takes a long time for taking off the workpiece 13 from the sheet 12. Particularly, nowadays, the workpiece 13 is developed to have a large size and a thin thickness, it becomes more difficult to take off the workpiece 13, and thus the working efficiency is reduced and the breakage rate is increased.

Therefore, it is in need of an innovative and inventive sheet for mounting a workpiece to solve the above-mentioned problems.

SUMMARY OF THE INVENTION

The present invention provides a sheet for mounting a workpiece. The sheet includes a sheet body. The sheet body has a top surface, a bottom surface, a plurality of foamed pores and a plurality of surface holes. The top surface is used for mounting a workpiece. The foamed pores are disposed in an interior of the sheet body. The surface holes have openings on the top surface and are independent and do not communicate with each other. The surface holes do not communicate with the foamed pores, and the surface holes are formed by machining and arranged in at least one pattern.

The present invention also provides a sheet for mounting a workpiece. The sheet includes a sheet body. The sheet body has a top surface, a bottom surface, a plurality of foamed pores and at least one surface groove. The top surface is used for mounting a workpiece. The foamed pores are disposed in an interior of the sheet body, and the at least one surface groove is disposed on the top surface. The surface groove does not communicate with the foamed pores, and the surface groove is formed by machining and arranged in at least one pattern.

In the present invention, the function of the surface holes and the surface groove may reduce the time and difficulty for taking off the workpiece from the sheet.

BRIEF DESCRIPTION OF THE DRAWINGS

The invention will be described according to the appended drawings in which.

DETAILED DESCRIPTION OF THE INVENTION

Figure 1:
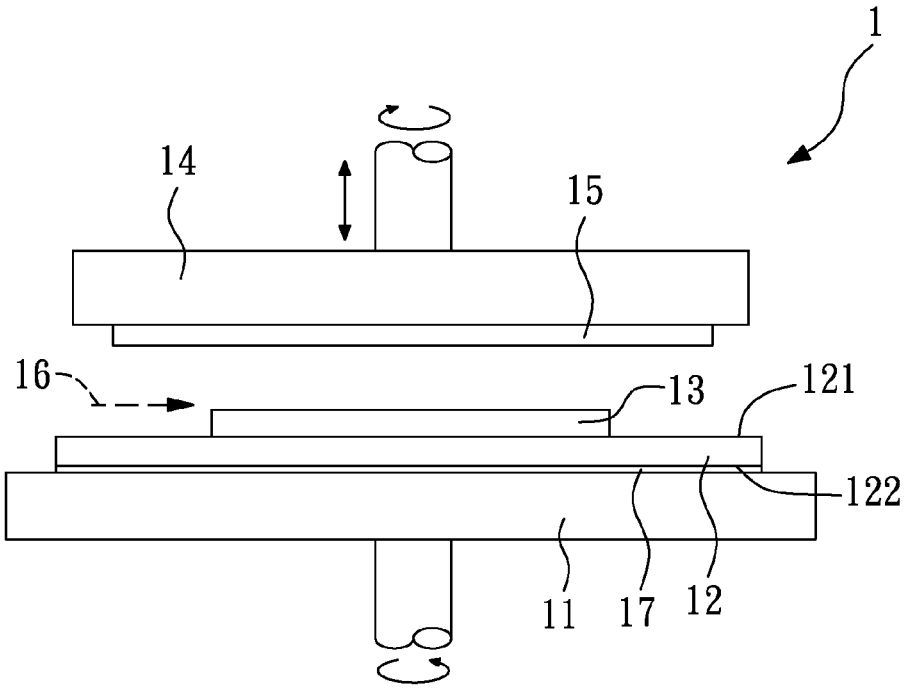
FIG. 1(Prior Art)
FIG. 1 is a schematic view of a polishing device using a conventional sheet for mounting a workpiece disclosed in U.S. Pat. No. 5,871,393.
Figure 2:
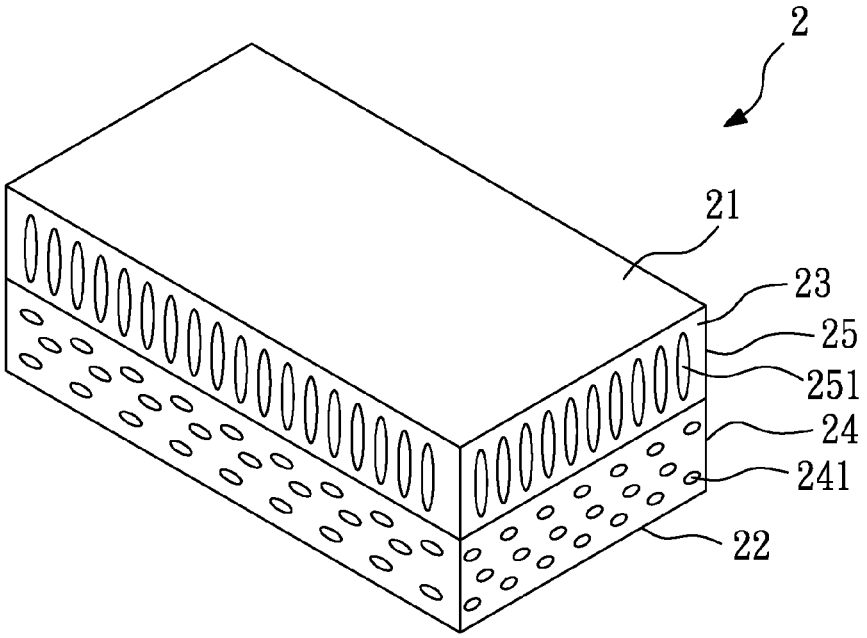
FIG. 2 and FIG. 3 are schematic views of a method for manufacturing a sheet for mounting a workpiece according to a first embodiment of the present invention.
Figure 3:
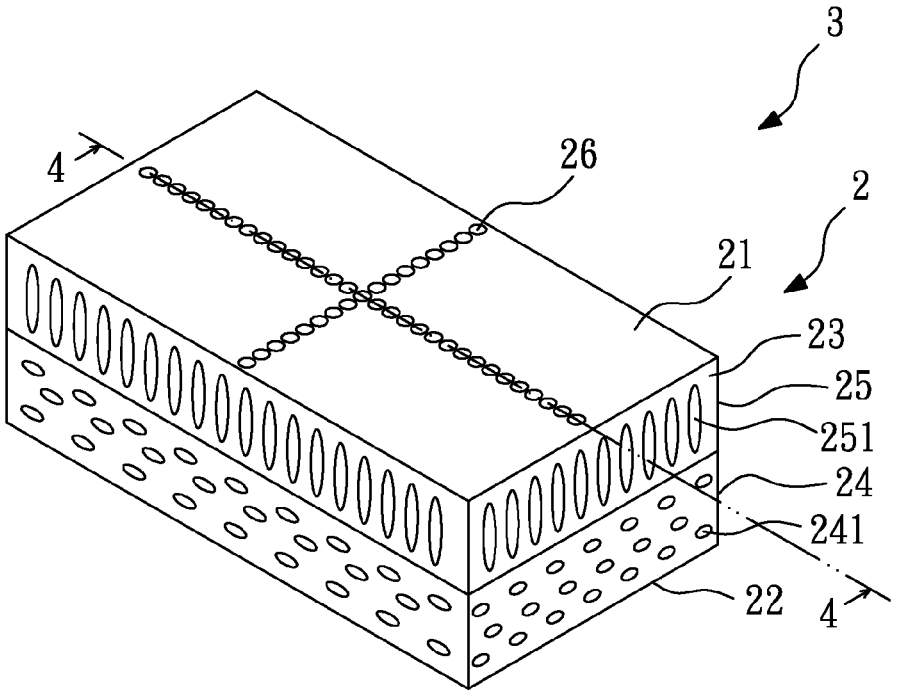

Referring to FIG. 2 and FIG. 3, schematic views of a method for manufacturing a sheet for mounting a workpiece according to a first embodiment of the present invention are illustrated. Firstly, referring to FIG. 2, a sheet body 2 is provided. The sheet body 2 has a top surface 21, a bottom surface 22 and at least one side surface 23. The sheet body 2 is a foaming material, and a plurality of foamed pores (for example, first foamed pores 241 and second foamed pores 251) is generated in the interior of the sheet body 2 in the foaming process. The top surface 21 is used for mounting a workpiece 13 (FIG. 1), and the bottom surface 22 is used for being adhered to a machine (for example, a lower base plate 11 in FIG. 1). The foamed pores are disposed in the sheet body 2 and are communicating holes. A part of the foamed pores have openings on the side surface 23.

In this embodiment, the material of the sheet body 2 is resin and is a double layer structure. It should be understood that the sheet body 2 may also be a single layer structure. The sheet body 2 includes a buffer layer 24 and a mounting layer 25. The mounting layer 25 is disposed at the buffer layer 24 for mounting the workpiece 13. The foamed holes include a plurality of first foamed pores 241 and a plurality of second foamed pores 251. The first foamed pores 241 are disposed at the buffer layer 24, the second foamed pores 251 are disposed at the mounting layer 25, and the compression ratio of the buffer layer 24 is higher than the compression ratio of the mounting layer 25. Preferably, the void content of the buffer layer 24 is higher than the void content of the mounting layer 25.

Figure 4:
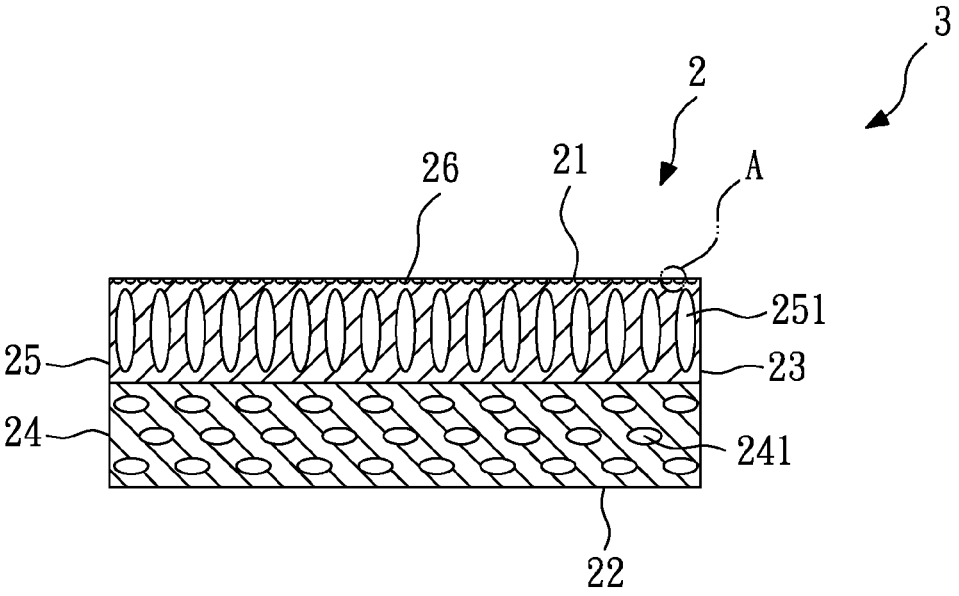
FIG. 4 is a schematic cross-sectional view taken along line 4-4 in FIG. 3.

Then, referring to FIGS. 3 and 4, wherein FIG. 4 is a schematic cross-sectional view taken along line 4-4 in FIG. 3. A plurality of surface holes 26 are formed on the top surface 21. In this embodiment, the surface holes 26 are formed by processing the top surface 21 of the mounting layer 25 with a laser, a cutter, a chisel, a welding burner, an electrical iron or a needle. The surface holes 26 are independent and do not communicate with each other. Further, the surface holes 26 do not communicate with the second foamed pores 251 so as to prevent the slurry 16 (FIG. 1) from entering the surface holes 26 via the second foamed pores 251 during polishing. That is, the surface holes 26 are not foamed pores but are formed by machining and arranged in at least one pattern.

Referring to FIGS. 3 and 4, a schematic three-dimensional view and a schematic cross-sectional view of a sheet for mounting a workpiece according to a first embodiment of the present invention are illustrated respectively. The sheet 3 includes a sheet body 2. The sheet body 2 has a top surface 21, a bottom surface 22, a plurality of foamed pores (for example, first foamed pores 241 and second foamed pores 251) and a plurality of surface holes 26. The top surface 21 is used for mounting a workpiece 13 (FIG. 1), and the bottom surface 22 is used for being adhered to the machine (for example, a lower base plate 11 in FIG. 1). The foamed pores are disposed in the sheet body 2 and are communicating holes.

In this embodiment, the sheet body 2 includes a buffer layer 24 and a mounting layer 25. The mounting layer 25 is disposed on the buffer layer 24 for mounting the workpiece 13. The foamed holes include a plurality of first foamed pores 241 and a plurality of second foamed pores 251. The first foamed pores 241 are disposed at the buffer layer 24, and the second foamed pores 251 are disposed at the mounting layer 25. The compression ratio of the buffer layer 24 is higher than the compression ratio of the mounting layer 25.

In this embodiment, the material of the buffer layer 24 is polyurethane (PU) resin, and the void content is above 60%, preferably, above 75%. The material of the mounting layer 25 is PU resin, polyvinyl chloride resin, polystyrene resin, polyethylene resin, polyamide resin, propylene resin or ethylene vinyl acetate resin. The void content of the mounting layer 25 is 30% to 60%, preferably, 40% to 50%. Furthermore, the compression ratio of the buffer layer 24 is above 30%, preferably, above 50%, which may be adjusted according to the requirement. The compression ratio of the mounting layer 25 is 25% to 40%.

The surface holes 26 have openings on the top surface 21, and are independent and do not communicate with each other. The surface holes 26 do not communicate with the foamed pores (for example, the first foamed pores 241 and the second foamed pores 251). The surface holes 26 are formed by machining and arranged in at least one pattern. The pattern may be a straight line, circular, annular, rectangular, triangular, polygonal, spiral, radial, irregular shape or any combination thereof.

Figure 5:
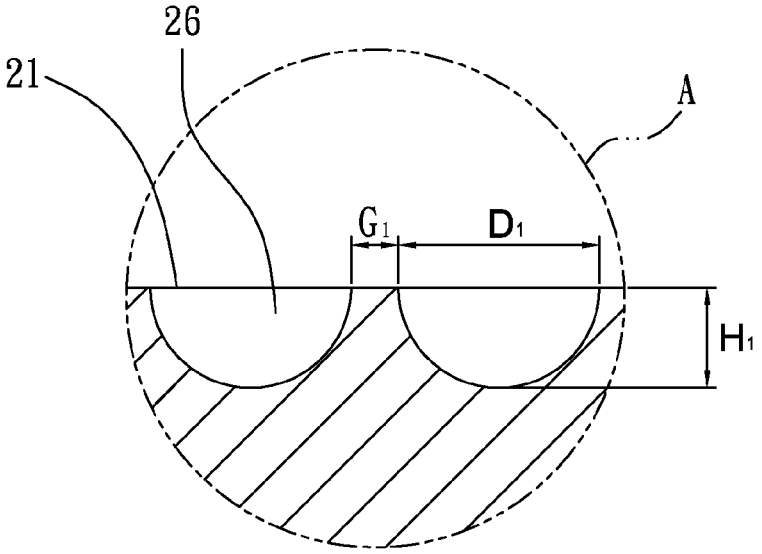
FIG. 5 is an enlarged schematic view of region A in FIG. 4.

Referring to FIG. 5, an enlarged schematic view of region A in FIG. 4 is illustrated. The diameter $D_1$ of the surface holes 26 is below 1 millimeter (mm), the depth $H_1$ is below 300 micrometers (μm), and the pitch between the two surface holes 26 is the first pitch $G_1$ which is below 0.3 mm. Preferably, the diameter $D_1$ is below 0.5 mm, the depth $H_1$ is below 200 μm, and the first pitch $G_1$ between the two surface holes 26 is below 0.05 mm.

Figure 6:
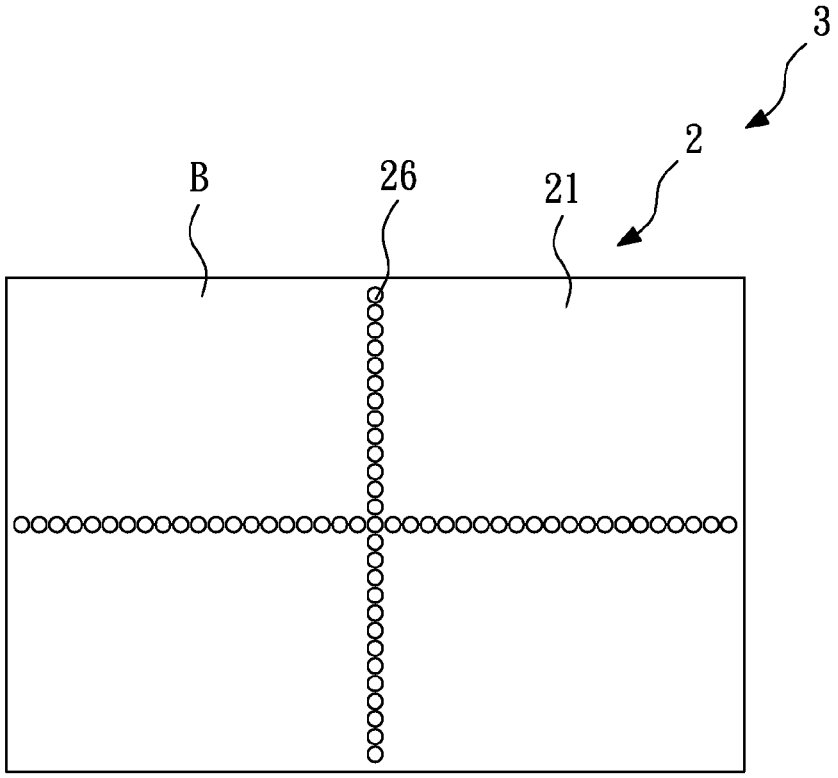
FIG. 6 is a schematic top view of a sheet for mounting a workpiece according to the first embodiment of the present invention.

Referring to FIG. 6, a schematic top view of a sheet for mounting a workpiece according to a first embodiment of the present invention is illustrated. The top surface 21 has an overall surface area, and the pattern of the surface holes 26 separates the top surface 21 into a plurality of small regions. The surface area of each small region is 1/100 to 1/2 of the overall surface area, preferably, 1/50 to 1/4. It should be noted that if the surface area of the small region is smaller than 1/100 of the overall surface area, the mounting force does not exist, so the surface area of each small region should not be smaller than 1/100 of the overall surface area, otherwise the force for mounting the workpiece 13 exerted by the sheet body 2 will be affected. In this embodiment, the pattern of the surface holes 26 is two crossed straight lines and separates the top surface 21 into four small regions B. The surface area of each small region B is 1/4 of the overall surface area.

Figure 7:
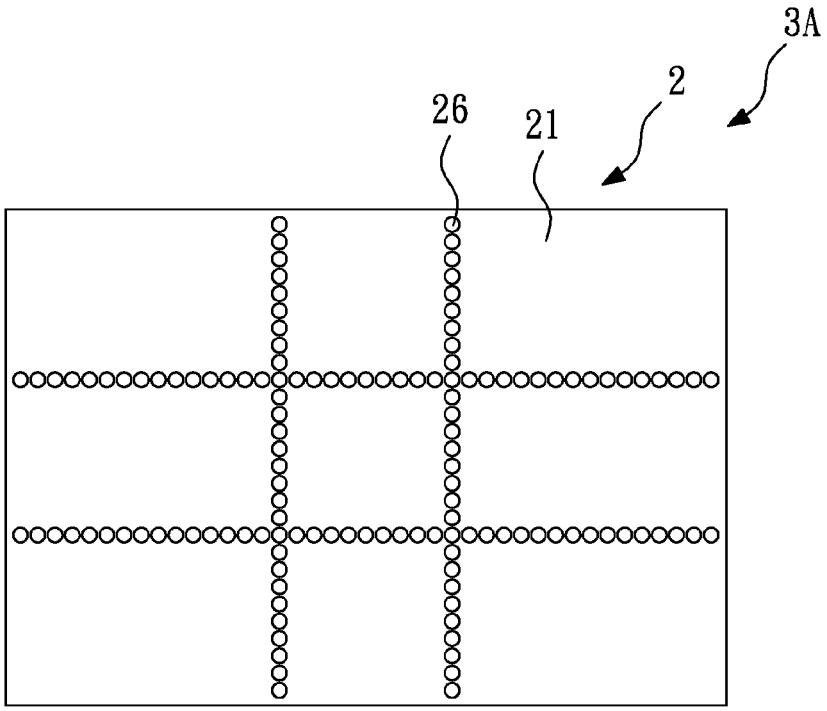
FIG. 7 is a schematic top view of a sheet for mounting a workpiece according to a second embodiment of the present invention.

Referring to FIG. 7, a schematic top view of a sheet for mounting a workpiece according to a second embodiment of the present invention is illustrated. In the sheet 3A of this embodiment, the pattern of the surface holes 26 is four crossed straight lines and separates the top surface 21 into nine small regions. The surface area of each small region is 1/9 of the overall surface area.

Figure 8:
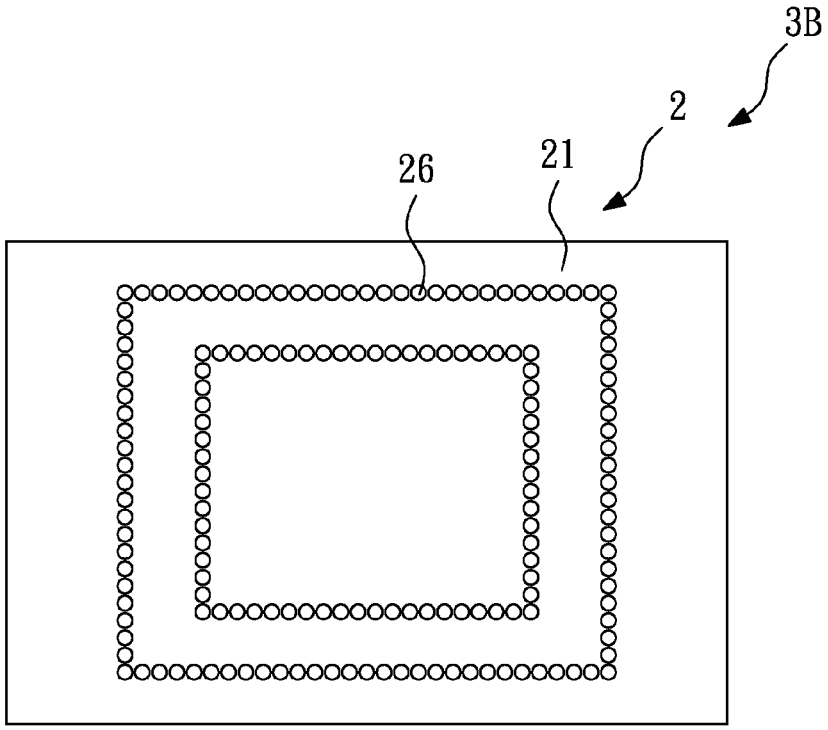
FIG. 8 is a schematic top view of a sheet for mounting a workpiece according to a third embodiment of the present invention.

Referring to FIG. 8, a schematic top view of a sheet for mounting a workpiece according to a third embodiment of the present invention is illustrated. In the sheet 3B of this embodiment, the pattern of the surface holes 26 is two concentric rectangles and the surface areas of the small regions are different.

Figure 9:
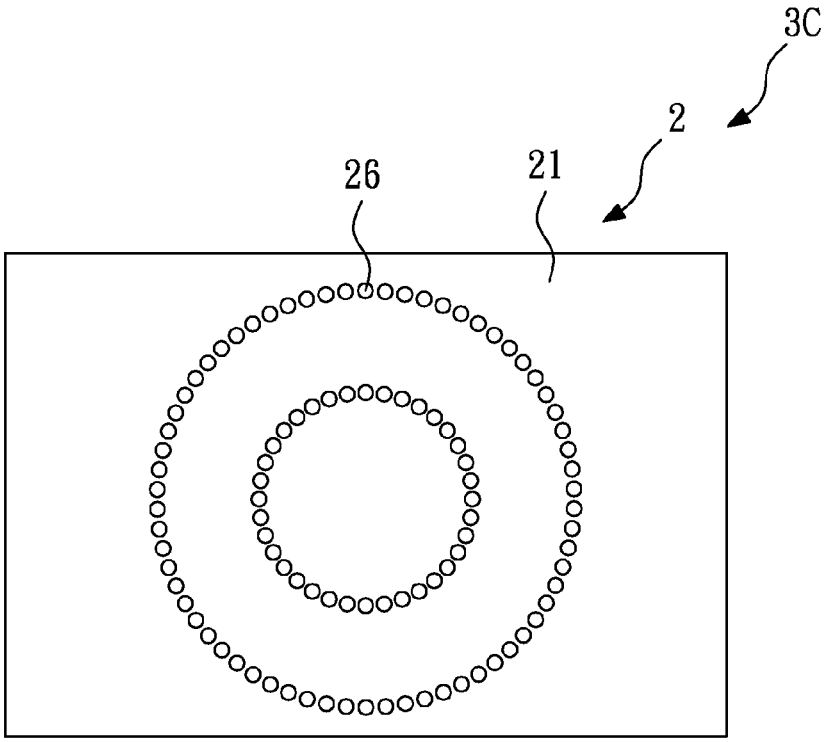
FIG. 9 is a schematic top view of a sheet for mounting a workpiece according to a fourth embodiment of the present invention.

Referring to FIG. 9, a schematic top view of a sheet for mounting a workpiece according to a fourth embodiment of the present invention is illustrated. In the sheet 3C of this embodiment, the pattern of the surface holes 26 is two concentric circles and the surface areas of the small regions are different.

Figure 10:
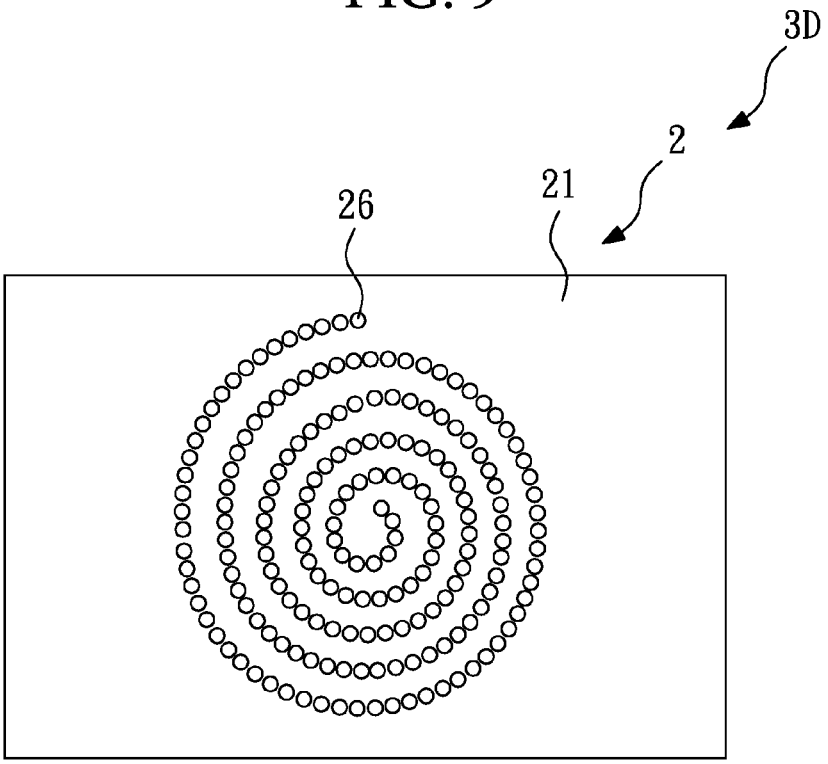
FIG. 10 is a schematic top view of a sheet for mounting a workpiece according to a fifth embodiment of the present invention.

Referring to FIG. 10, a schematic top view of a sheet for mounting a workpiece according to a fifth embodiment of the present invention is illustrated. In the sheet 3D of this embodiment, the pattern of the surface holes 26 is spiral.

Figure 11:
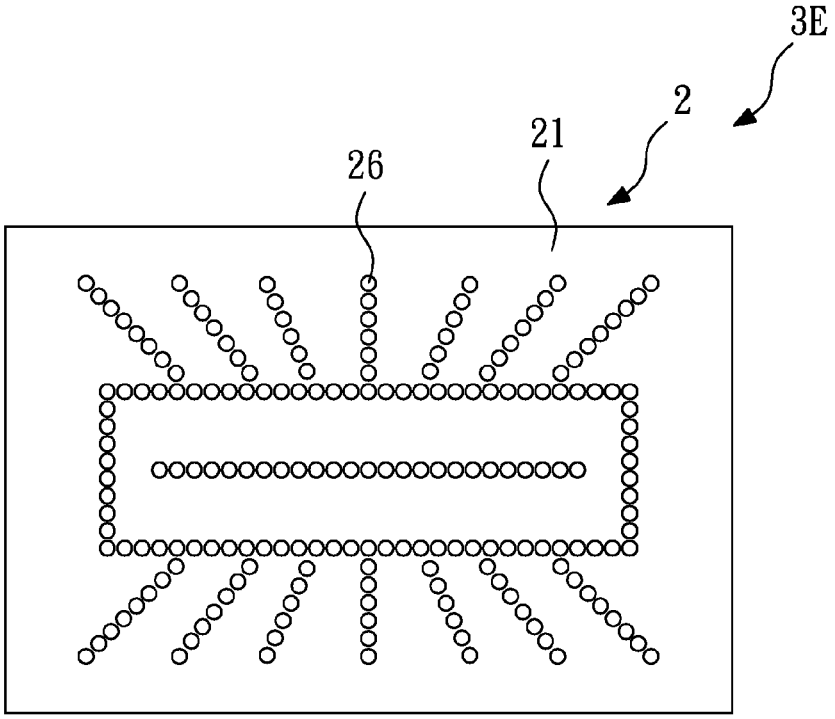
FIG. 11 is a schematic top view of a sheet for mounting a workpiece according to a sixth embodiment of the present invention.

Referring to FIG. 11, a schematic top view of a sheet for mounting a workpiece according to a sixth embodiment of the present invention is illustrated. In the sheet 3E of this embodiment, the pattern of the surface holes 26 is a combination of straight line, rectangular, and radial shapes.

Figure 12:
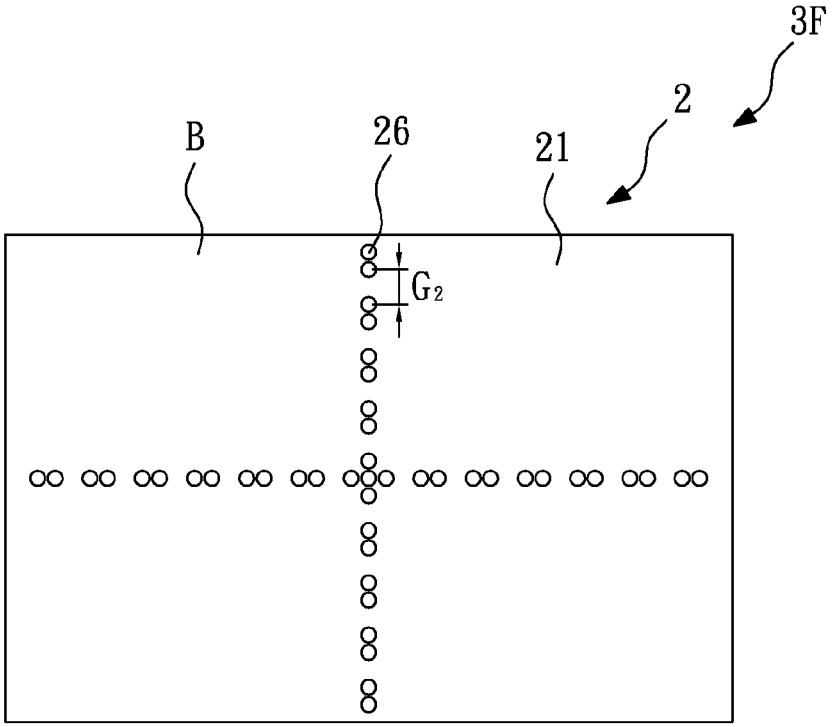
FIG. 12 is a schematic top view of a sheet for mounting a workpiece according to a seventh embodiment of the present invention.

Referring to FIG. 12, a schematic top view of a sheet for mounting a workpiece according to a seventh embodiment of the present invention is illustrated. The sheet 3F of this embodiment is substantially the same as the sheet 3 (FIG. 6) of the first embodiment, and the difference is that in this embodiment, the surface holes 26 are arranged in an imaginary straight line, that is, the pitch between some surface holes 26 is a second pitch $G_2$, and the second pitch $G_2$ is greater than the first pitch $G_1$.

Figure 13:
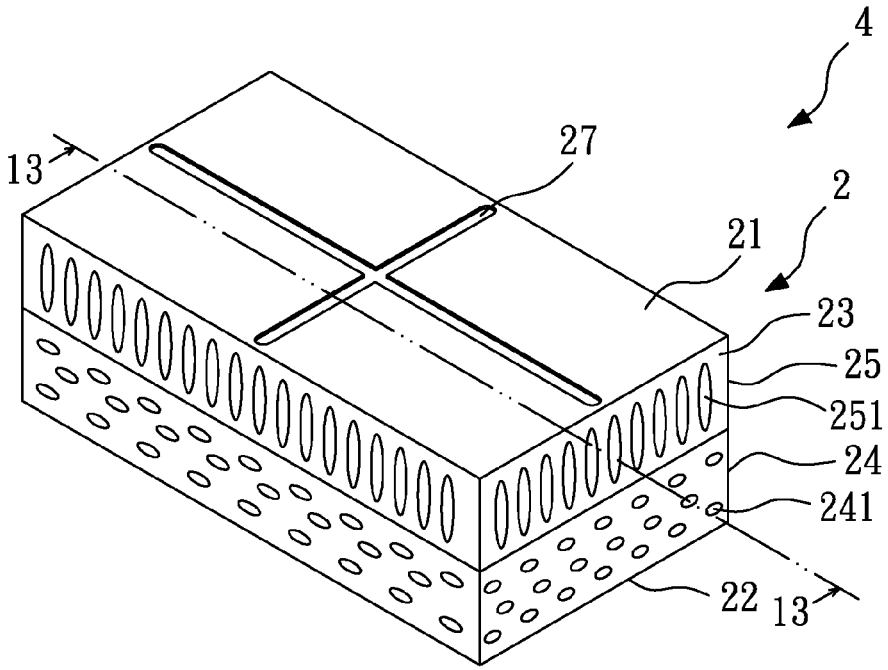
FIG. 13 is a schematic three-dimensional view of a sheet for mounting a workpiece according to an eighth embodiment of the present invention.
Figure 14:
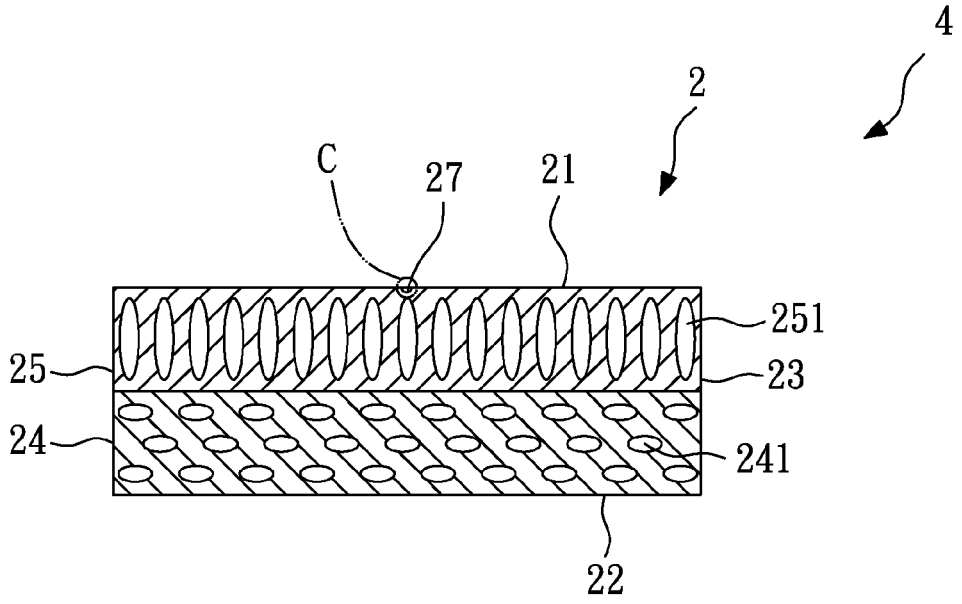
FIG. 14 is a schematic cross-sectional view of a sheet for mounting a workpiece according to the eighth embodiment of the present invention.

Referring to FIG. 13 and FIG. 14, a schematic three-dimensional view and a schematic cross-sectional view of a sheet for mounting a workpiece according to an eighth embodiment of the present invention are illustrated respectively. The sheet 4 of this embodiment is substantially the same as the sheet 3 (FIG. 3 and FIG. 4) of the first embodiment. The same elements are designated with the same reference numerals. The difference lies in that in this embodiment, the sheet body 2 of the sheet 4 has at least one surface groove 27 but do not have the surface holes 26 (FIG. 3 and FIG. 4). However, it should be understood that the sheet body 2 of the sheet 4 may have the surface groove 27 and the surface holes 26 at the same time.

The surface groove 27 is disposed on the top surface 21. The surface groove 27 does not communicate with the foamed pores (for example, the first foamed pores 241 and the second foamed pores 251). The surface groove 27 is formed by machining and arranged in at least one pattern. The pattern may be a straight line, circular, annular, rectangular, triangular, polygonal, spiral, radial, irregular shape or any combination thereof.

Figure 15:
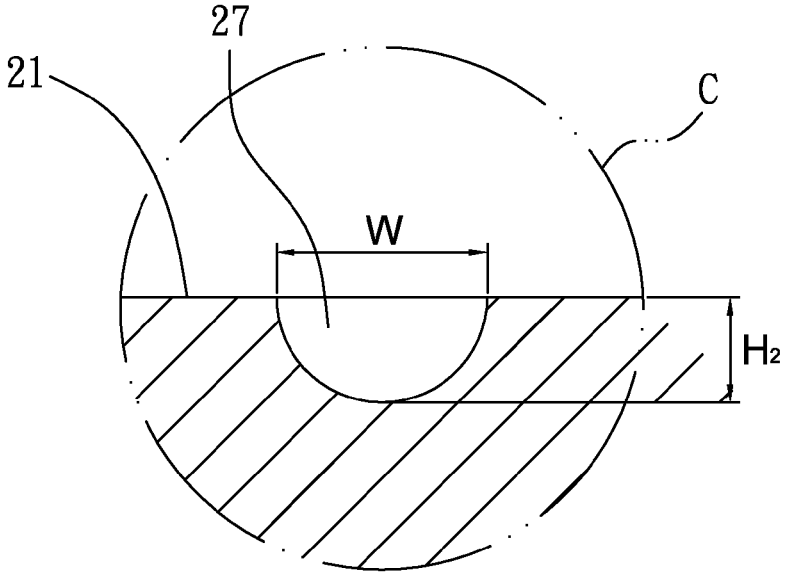
FIG. 15 is an enlarged schematic view of region C in FIG. 14.

Referring to FIG. 15, an enlarged schematic view of region C in FIG. 14 is illustrated. The width W of the surface groove 27 is below 1 mm, and the depth $H_2$ is below 300 μm. Preferably, the width W is below 0.5 mm, and the depth $H_2$ is below 200 μm.

Figure 16:
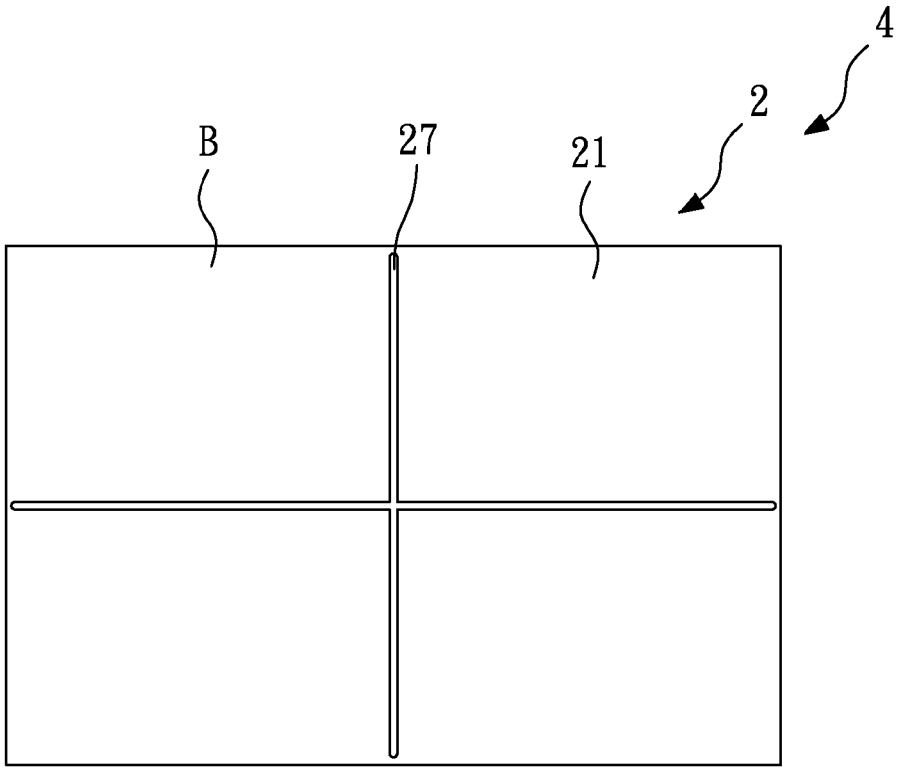
FIG. 16 is a schematic top view of a sheet for mounting a workpiece according to the eighth embodiment of the present invention.

Referring to FIG. 16, a schematic top view of a sheet for mounting a workpiece according to an eighth embodiment of the present invention is illustrated. The top surface 21 has an overall surface area, the pattern of the surface groove 27 separates the top surface 21 into a plurality of small regions B, and the surface area of each small region B is 1/100 to ½ of the overall surface area, preferably is 1/50 to ¼. It should be noted that if the surface area of the small region B is smaller than 1/100 of the overall surface area, the mounting force does not exist, so the surface area of each the small region B should not be smaller than 1/100 of the overall surface area, otherwise the force for mounting the workpiece 13 exerted by the sheet body 2 will be affected. In this embodiment, the pattern of the surface groove 27 is two crossed straight lines and separates the top surface 21 into four small regions B. The surface area of each small region B is ¼ of the overall surface area.

Figure 17:
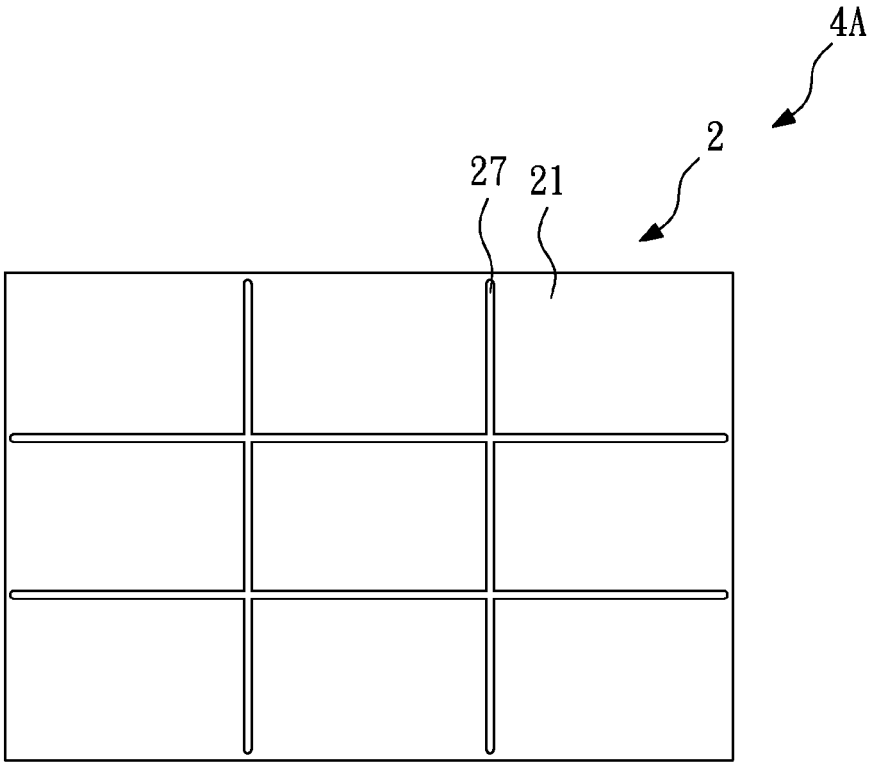
FIG. 17 is a schematic top view of a sheet for mounting a workpiece according to a ninth embodiment of the present invention.

Referring to FIG. 17, a schematic top view of a sheet for mounting a workpiece according to a ninth embodiment of the present invention is illustrated. In the sheet 4A of this embodiment, the pattern of the surface groove 27 is four crossed straight lines and separates the top surface 21 into nine small regions. The surface area of each small region is 1/9 of the overall surface area.

Figure 18:
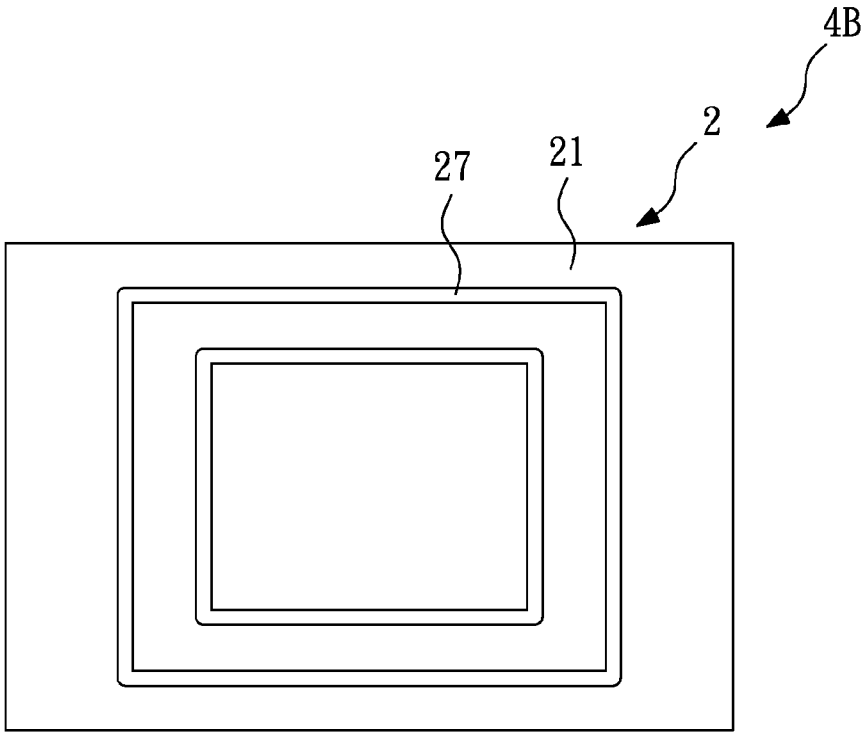
FIG. 18 is a schematic top view of a sheet for mounting a workpiece according to a tenth embodiment of the present invention.

Referring to FIG. 18, a schematic top view of a sheet for mounting a workpiece according to a tenth embodiment of the present invention is illustrated. In the sheet 4B of this embodiment, the pattern of the surface groove 27 is two concentric rectangles and the surface areas of the small regions are different.

Figure 19:
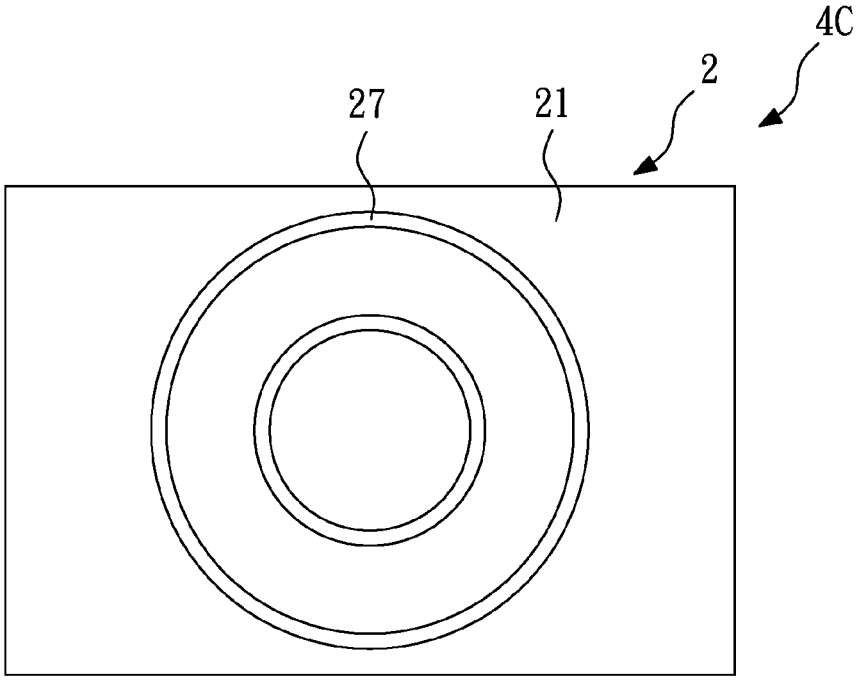
FIG. 19 is a schematic top view of a sheet for mounting a workpiece according to an eleventh embodiment of the present invention.

Referring to FIG. 19, a schematic top view of a sheet for mounting a workpiece according to an eleventh embodiment of the present invention is illustrated. In the sheet 4C of this embodiment, the pattern of the surface groove 27 is two concentric circles and the surface areas of the small regions are different.

Figure 20:
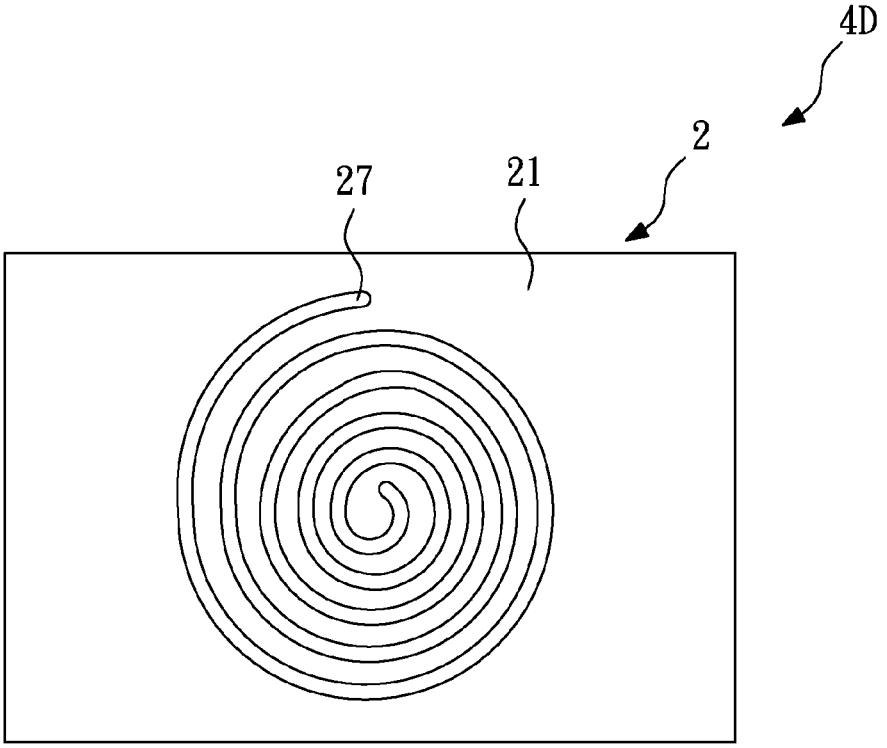
FIG. 20 is a schematic top view of a sheet for mounting a workpiece according to a twelfth embodiment of the present invention.

Referring to FIG. 20, a schematic top view of a sheet for mounting a workpiece according to a twelfth embodiment of the present invention is illustrated. In the sheet 4D of this embodiment, the pattern of the surface groove 27 is spiral.

Figure 21:
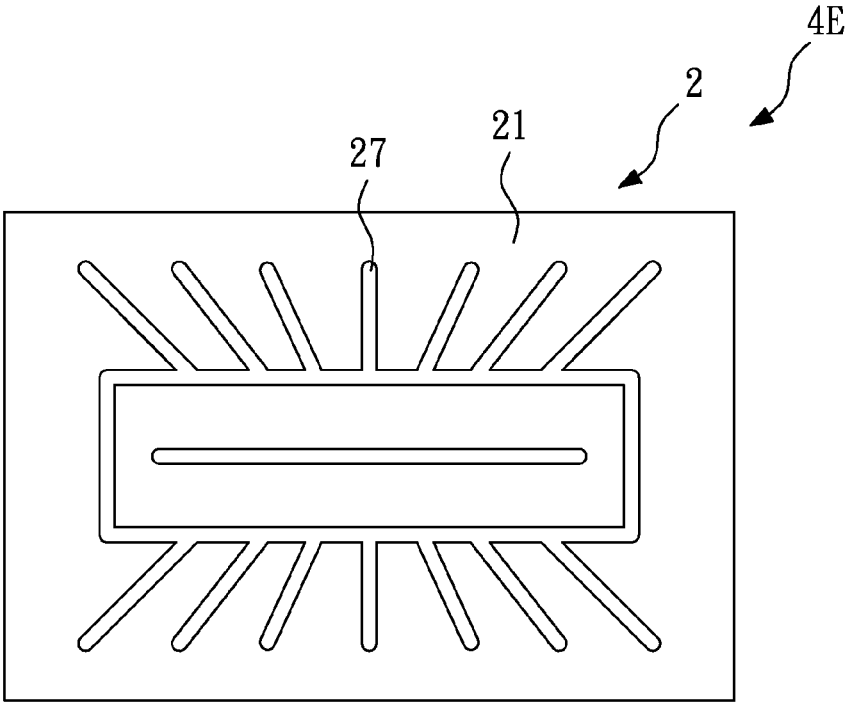
FIG. 21 is a schematic top view of a sheet for mounting a workpiece according to a thirteenth embodiment of the present invention.

Referring to FIG. 21, a schematic top view of a sheet for mounting a workpiece according to a thirteenth embodiment of the present invention is illustrated. In the sheet 4E of this embodiment, the pattern of the surface groove 27 is a combination of straight line, rectangular, and radial shapes.

Figure 22:
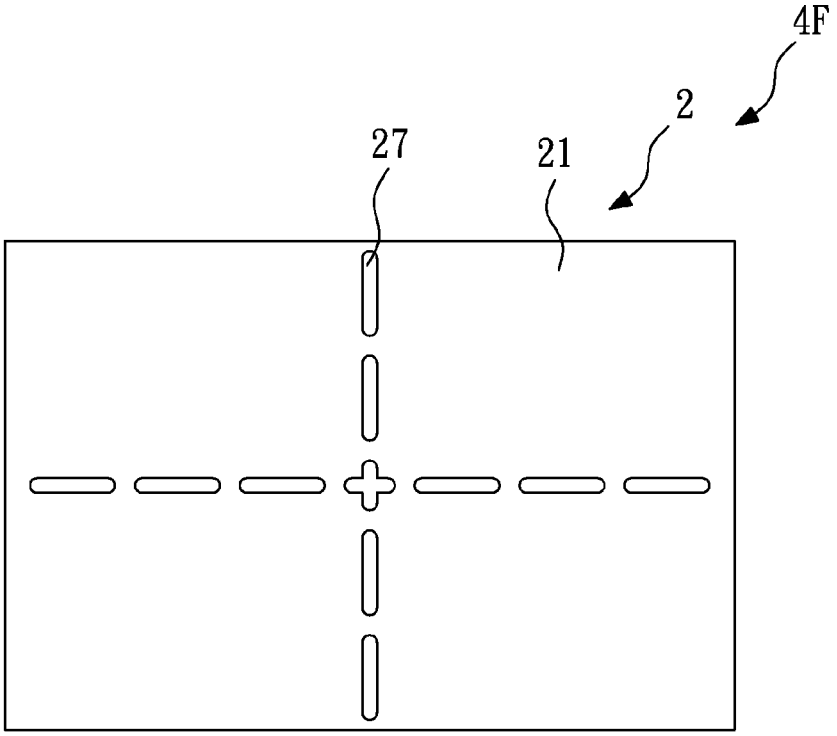
FIG. 22 is a schematic top view of a sheet for mounting a workpiece according to a fourteenth embodiment of the present invention.

Referring to FIG. 22, a schematic top view of a sheet for mounting a workpiece according to a fourteenth embodiment of the present invention is illustrated. The sheet 4F of this embodiment is substantially the same as the sheet 4 (FIG. 16) of the eighth embodiment and the difference lies in that in this embodiment, the surface groove 27 is a discontinuous imaginary line, that is, the surface groove 27 is formed by a plurality of discontinuous line segments.

In the present invention, the function of the surface holes 26 and the surface groove 27 may reduce the time and difficulty for taking off the workpiece 13 from the sheet. Compared with the prior art, the present invention may reduce more than a half of the time. Furthermore, with the special design, the pattern of the surface holes 26 and the surface groove 27 will not influence ability of the sheet for mounting the workpiece 13 and will not influence the polishing quality of the workpiece 13.

While several embodiments of the present invention have been illustrated and described, various modifications and improvements can be made by those skilled in the art. The embodiments of the present invention are therefore described in an illustrative but not restrictive sense. It is intended that the present invention should not be limited to the particular forms as illustrated, and that all modifications which maintain the spirit and scope of the present invention are within the scope defined in the appended claims.

What is claimed is:

1. A sheet for mounting a workpiece, comprising:

a sheet body, having a top surface, a bottom surface, a plurality of foamed pores and a plurality of surface holes, wherein the top surface is used for mounting a workpiece, the foamed pores are disposed in an interior of the sheet body, the surface holes have openings on the top surface and are independent and do not communicate with each other, the surface holes do not communicate with the foamed pores, and the surface holes are formed by machining and arranged in at least one pattern, wherein a diameter of the surface holes is below 1 millimeter (mm), a depth is below 300 micrometers (μm), and a first pitch of the two surface holes is below 0.3 mm.

2. The sheet for mounting a workpiece according to claim 1, wherein the top surface has an overall surface area, the pattern separates the top surface into a plurality of small regions, and the surface area of each small region is 1/100 to 1/2 of the overall surface area.

3. The sheet for mounting a workpiece according to claim 1, wherein the foamed pores are holes generated in a foaming process, and the surface holes are formed by processing the top surface with a laser, a cutter, a chisel, a welding burner, an electrical iron or a needle.

4. The sheet for mounting a workpiece according to claim 1, wherein the pattern is a straight line, circular, annular, rectangular, triangular, polygonal, spiral, radial, irregular shape or any combination thereof.

5. The sheet for mounting a workpiece according to claim 1, wherein the pattern is an imaginary straight line, a pitch between a part of the two surface holes is a first pitch, a pitch between a part of the two surface holes is a second pitch, and the second pitch is greater than the first pitch.

6. The sheet for mounting a workpiece according to claim 1, wherein the sheet body comprises a buffer layer and a mounting layer, the mounting layer is disposed on the buffer layer for mounting the workpiece, the foamed pores comprise a plurality of first foamed pores and a plurality of second foamed pores, the first foamed pores are disposed at the buffer layer, the second foamed pores are disposed at the mounting layer, the surface holes are disposed on a top surface of the mounting layer, and a compression ratio of the buffer layer is higher than a compression ratio of the mounting layer.

7. A sheet for mounting a workpiece, comprising:

a sheet body, having a top surface, a bottom surface, a plurality of foamed pores and at least one surface groove, wherein the top surface is used for mounting a workpiece, the foamed pores are disposed in an interior of the sheet body, the at least one surface groove is disposed on the top surface, the surface groove does not communicate with the foamed pores, the surface groove is formed by machining and arranged in at least one pattern, wherein the sheet body comprises a buffer layer and a mounting layer, the mounting layer is disposed on the buffer layer for mounting the workpiece, the foamed pores comprise a plurality of first foamed pores and a plurality of second foamed pores, the first foamed pores are disposed at the buffer layer, the second foamed pores are disposed at the mounting layer, the surface grooves are disposed on a top surface of the mounting layer, and a compression ratio of the buffer layer is higher than a compression ratio of the mounting layer.

8. The sheet for mounting a workpiece according to claim 7, wherein the top surface has an overall surface area, the pattern separates the top surface into a plurality of small regions, and the surface area of each small region is 1/100 to 1/2 of the overall surface area.

9. The sheet for mounting a workpiece according to claim 7, wherein the foamed pores are holes generated in a foaming process, and the surface grooves are formed by processing the top surface with a laser, a cutter, a chisel, a welding burner, an electrical iron or a needle.

10. The sheet for mounting a workpiece according to claim 7, wherein a width of the surface groove is below 1 millimeter (mm) and a depth of the surface groove is below 300 micrometers (μm).

11. The sheet for mounting a workpiece according to claim 7, wherein the pattern is a straight line, circular, annular, rectangular, triangular, polygonal, spiral, radial, irregular shape or any combination thereof.

12. The sheet for mounting a workpiece according to claim 7, further comprising a plurality of surface holes that have openings on the top surface, wherein the surface holes are independent and do not communicate with each other, the surface holes do not communicate with the foamed pores, and the surface holes are formed by machining.

* * * * *